US005839514A

United States Patent [19]

Gipson

[11] Patent Number: 5,839,514

[45] Date of Patent: Nov. 24, 1998

[54] METHOD AND APPARATUS FOR INJECTION OF TUBING INTO WELLS

[75] Inventor: Thomas C. Gipson, Cisco, Tex.

[73] Assignee: Fleet Cementers, Inc., Cisco, Tex.

[21] Appl. No.: 862,745

[22] Filed: May 23, 1997

[51] Int. Cl.[6] ..... E21B 19/22

[52] U.S. Cl. ..... 166/384; 166/77.2; 166/85.5; 242/399.1; 242/596.3; 254/288; 254/332; 254/333

[58] Field of Search ..... 166/77.2, 77.1, 166/85.5, 384, 385; 242/399.1, 399.2, 596.3; 254/281, 288, 326, 332, 333

[56] References Cited

U.S. PATENT DOCUMENTS

| | | | |
|---|---|---|---|
| 3,116,793 | 1/1964 | McStravick | 166/77.2 X |
| 3,841,407 | 10/1974 | Bozeman | 166/77.3 X |
| 4,249,600 | 2/1981 | Bailey | 166/77.2 |
| 4,553,590 | 11/1985 | Phillips | 254/332 X |
| 4,673,035 | 6/1987 | Gipson | 166/77.2 |
| 5,439,066 | 8/1995 | Gipson | 166/50 X |
| 5,660,235 | 8/1997 | Sola | 166/77.2 X |
| 5,765,643 | 6/1998 | Shaaban et al. | 166/384 |

*Primary Examiner*—George Suchfield
*Attorney, Agent, or Firm*—Miller, Sisson, Chapman & Nash, P.C.

[57] ABSTRACT

An improved apparatus and method for injecting and retrieving a length of coiled tubing and storing the tubing on a storage spool. An injector reel is pivotally mounted on a frame such that coiled tubing may be angularly injected to shallow, horizontal wells. A hold-down assembly is provided to individually adjust the pressure applied to the coiled tubing as it is injected into or retrieved from a well. The positioning of the injector reel and the storage spool in the injecting mode ensures a greater degree of wrapping of the coiled tubing around the injector reel to improve the control of the injection and retraction of the tubing. A vertically and horizontally adjustable storage spool cradle enables the operator to vary the width and diameter of the storage spools used in the apparatus.

11 Claims, 8 Drawing Sheets

METHOD AND APPARATUS FOR INJECTION OF TUBING INTO WELLS

BACKGROUND OF THE INVENTION

The present invention relates to an improved coiled tubing injector. More particularly, the present invention relates to a coiled tubing injector mounted on a mobile frame with means for an adjustable, quick change of a storage reel or spool, means for varying the holding pressure of coiled tubing against the injection reel, and means for angular injection of coiled tubing into a wellhead.

The general background relating to coiled tubing injector units is described in the inventor's previous U.S. Pat. No. 4,673,035 which is incorporated herein by reference for all purposes.

It has been found that by increasing the degree of wrap of the coiled tubing around the injector reel and by being able to adjust the amount of pressure applied against the tubing at various locations around the wrap, injection of the tubing into the wellhead is improved. Greater depths of injection may be achieved much more quickly.

Further, there has been a need to accommodate various widths and diameters of tubing storage spools. Considerable time and effort are expended in the removal and replacement of a spent storage spool. By providing a means to quickly change the spool and to adjust for a different spool width or diameter (diameter being generally understood as flange height of a spool), the present invention increases productivity and reduces the cost of operation.

Angular or horizontal well drilling has become an increasingly important feature in oil and gas production as well as in environmental remediation procedures. There has developed a need to be able to inject extensive runs of coiled tubing (1000–2000 feet) into shallow, horizontal wellbores. However, it has been difficult to inject coiled tubing through the sharp bend of a shallow, horizontal well. The present invention enables the operator to angularly inject coiled tubing into such a wellhead. The increased wrap of the coiled tubing around the injector reel with the capability of being able to adjust the pressure on the wrapped tubing provided by the present invention further improves the ability of the operator to inject coiled tubing into a shallow, horizontal wellbore.

SUMMARY OF THE INVENTION

The improvements in coiled tubing injection provided by the present invention are achieved by a unique arrangement of structural elements. A mobile frame accommodates a cradle which supports a coiled tubing storage spool. The cradle may be provided with a traversing mechanism which allows the storage spool to slidably reciprocate across the frame during the return of coiled tubing to the spool to distribute the tubing evenly on the storage spool. The cradle has a pair of opposed pivotable bullnose arms which engage openings in the arms are slidably adjustable both horizontally and vertically to accept spools of varying widths and diameters within the same cradle. A mast is pivotably attached to the frame to raise and lower an injector reel rotatably mounted on an opposite end of the boom arm from a first stored position to a second tubing injection position. A drive mechanism is attached to the injector reel to rotate the injector reel to dispense or retrieve the coiled tubing. The injecting position results in the injector reel being generally positioned to inject the coiled tubing into a well or hole in the earth's surface. The injecting position may be vertical or generally 90° to the earth's surface or it may be angled at less than 90° to facilitate injection into a shallow horizontal well depending upon the embodiment utilized. A separate drive is provided for the storage spool to cooperate with the injector reel in injecting or retrieving the coiled tubing. A hold down assembly is mounted around a portion of the circumference of the injector reel for exerting pressure against the coiled tubing over more than 90° of injector reel circumference. The hold down assembly has a multiplicity of individual hold down mechanisms which enable the operator to vary the pressure exerted on the coiled tubing at any location around the circumference of the reel where there is positive engagement of the tubing with the rollers of the assembly. The apparatus is provided with coiled tubing straighteners; one of the straighteners in the angular injection mode is housed within the mobile frame and the other is attached above the wellbore.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

It should be understood by one of ordinary skill in the art that much of the basic operation of the present inventive coiled tubing injection apparatus is detailed in U.S. Pat. No. 4,673,035 which is incorporated herein by reference for all purposes. The instant description emphasizes the improvements to the present apparatus over U.S. Pat. No. 4,673,035.

Figure 1:
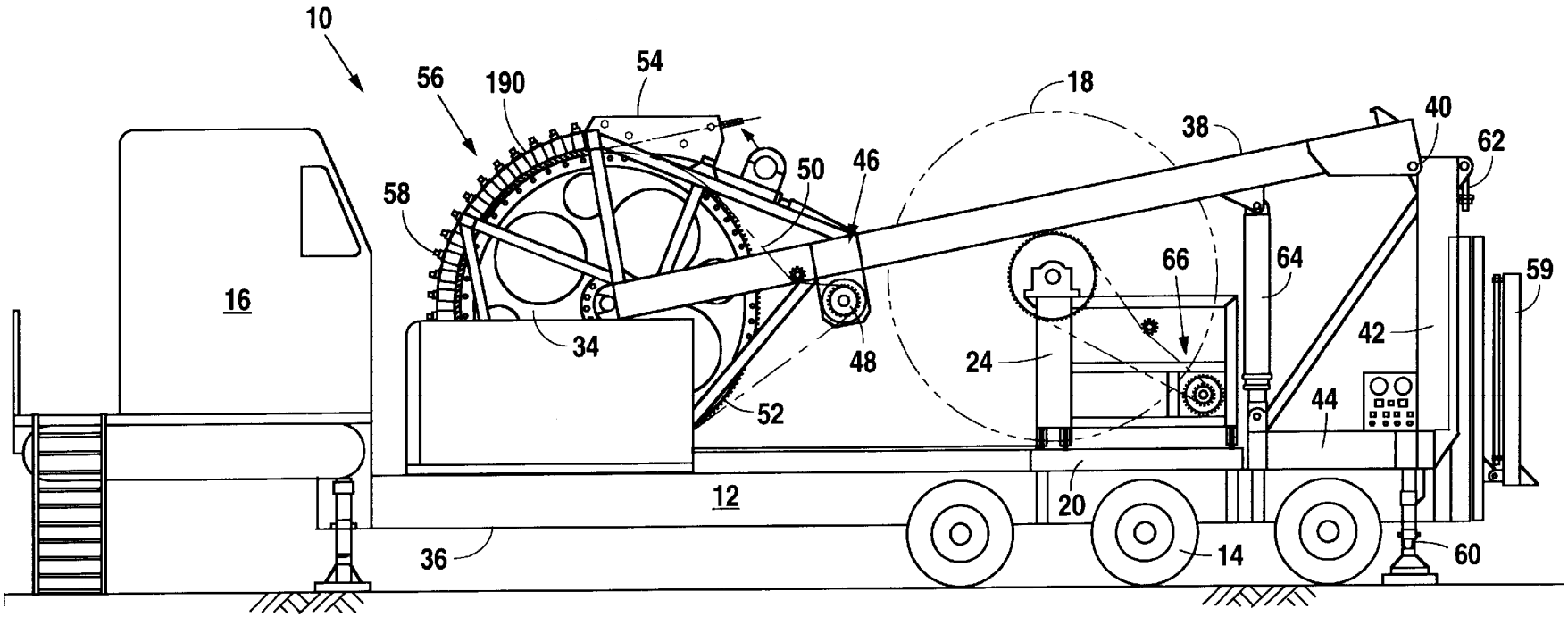
FIG. 1 is a side elevation view of the tubing injector apparatus constructed according to the teachings of the present invention. The injector reel is positioned in the stored position.

Referring to FIG. 1, there is shown a preferred embodiment of the present invention indicated generally at reference 10. In the embodiment shown in FIG. 1, the apparatus 10 is mounted on a trailer but could be mounted to a truck (not shown) or on a separate frame (not shown) which could be slid or lifted onto or off of a truck or trailer. As shown in FIG. 1, the apparatus 10 is mounted on a mobile frame 12 having wheels 14 and a control cabin 16.

Figure 14:
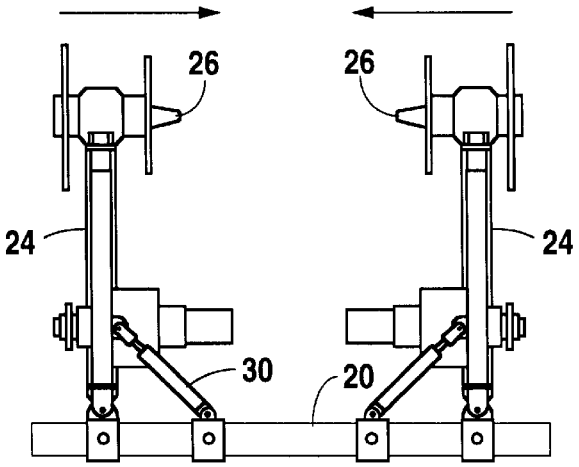
FIG. 14 is an end view of the storage spool cradle with the bullnose arms in the inserted position for a narrow width spool.
Figure 15:
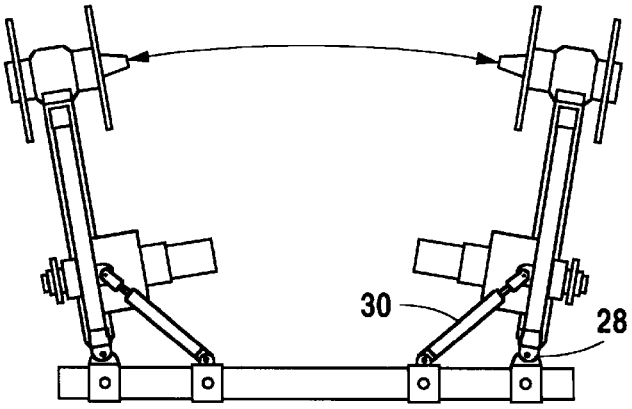
FIG. 15 is an end view of the storage spool cradle with the bullnose arms in the retract position for a wide spool.

A coiled tubing storage reel or spool 18 is mounted on a cradle 20, and coiled tubing 22 is stored thereon. The cradle 20 is attached to a traversing mechanism (not shown) as described in U.S. Pat. No. 4,673,035, which allows the cradle 20 to be reciprocated perpendicularly to the axis of the frame 12. Spool side frames or supports 24 are slidingly affixed to the cradle 20 by telescoping connections 25 and 27 so that the opposed bullnose assemblies 26 may be moved closer together or further apart depending upon the width of the particular storage spool being used (see FIGS. 13 and 14). Spool side supports 24 and the corresponding bullnose assemblies 26 may be pivoted outwardly as shown in FIG. 15 to retract the bullnose assemblies from the storage spool. Hydraulic cylinders 30 are utilized to urge the supports 24 outward about pivot joints 28.

Figure 4A:
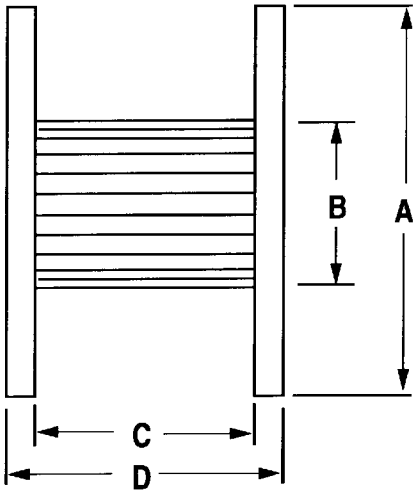
Fig. 4A (PRIOR ART)
FIG. 4A illustrates a standard storage spool of the prior art.
Figure 4:
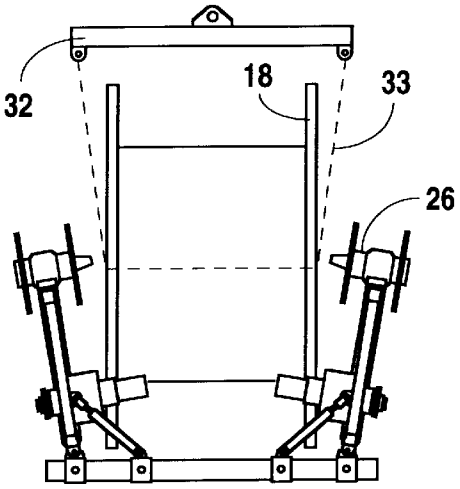
FIG. 4 illustrates the bullnose arms of the present invention in the retracted position to accept a storage spool.

FIG. 4 illustrates the quick placement of a storage reel or spool 18, by rigging the spool to spreader bar 32 with chain 33. The bullnose assemblies 26 are pivotally retracted to enable the spool to be removed or installed.

Turning again to FIG. 1, injector reel 34 is shown in the stored position at the front end 36 of the frame 12. Reel 34 is rotatably attached to one end of boom arm or mast 38. Mast 38 is attached at hinge member 40 to mast riser 42. Mast riser 42 is attached to the back end 44 of frame 12.

Injector reel 34 is further provided with a drive mechanism 46 which includes a hydraulic drive motor 48, a drive chain linkage 50, and sprocket assembly 52 extending circumferentially around the injector reel 34.

Figure 5:
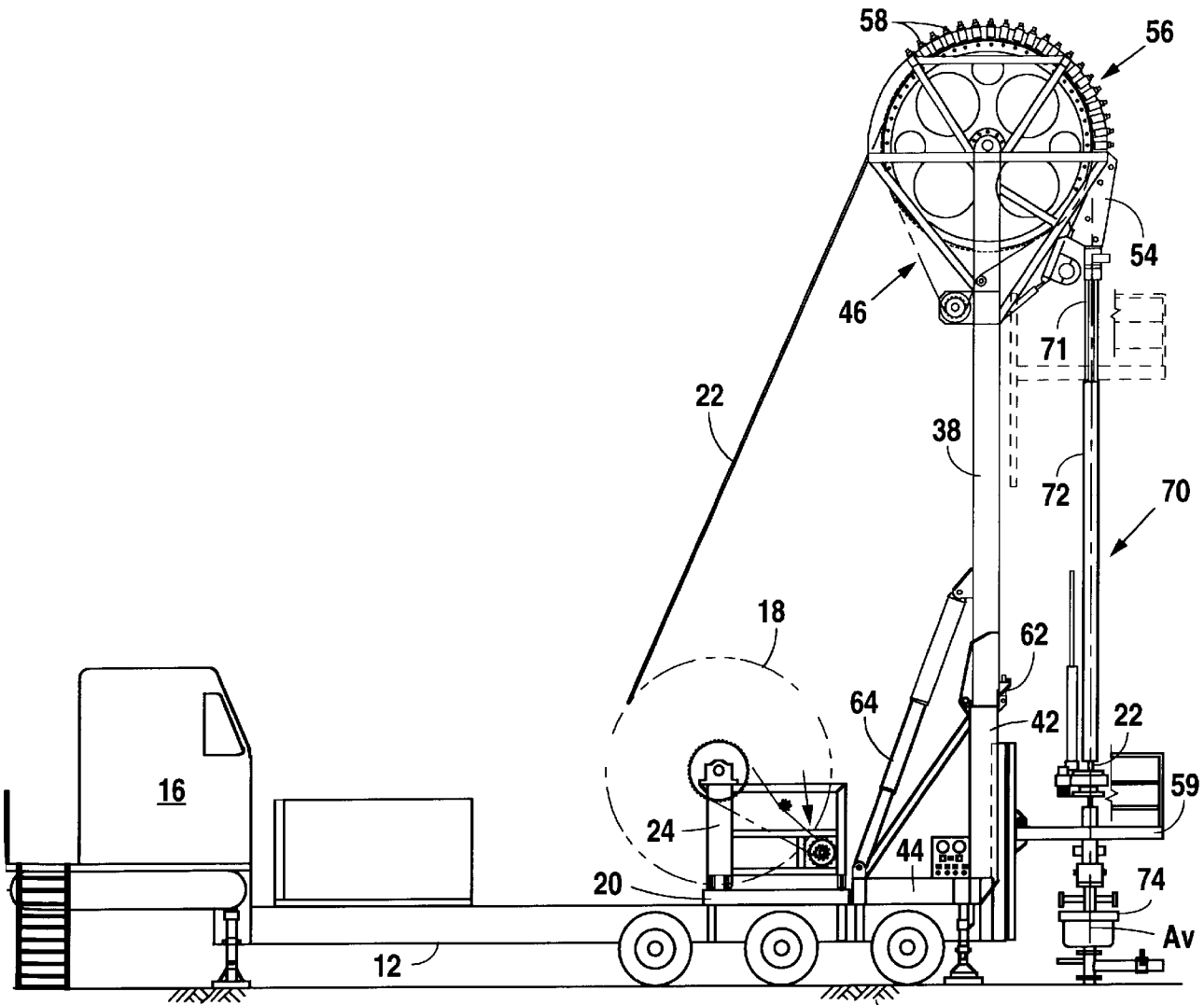
FIG. 5 shows a side elevation view of the apparatus constructed according to the teaching of the present invention in a first alternative injecting position.

Reel support frame 190 also extends circumferentially around the reel 34 and supports the straightener assembly 54 and the hold down assembly 56. Hold-down assembly 56 consists of a multiplicity of separate hold down mechanism 58. In the preferred embodiment twenty hold-down mechanisms are mounted around a portion of the circumference of the injector reel 34 to exert pressure against the coiled tubing over more than 90° of the injector reel circumference. FIG. 5 illustrates the degree of wrap that is provided by the hold-down assembly 56 when the injector reel 34 is in the tubing injection position.

Also shown in FIG. 1 is the hydraulically activated elevating work floor 59, leveling cylinders 60, swing lock 62, mast lift cylinder 64, and storage spool drive mechanism 66.

Figure 2:
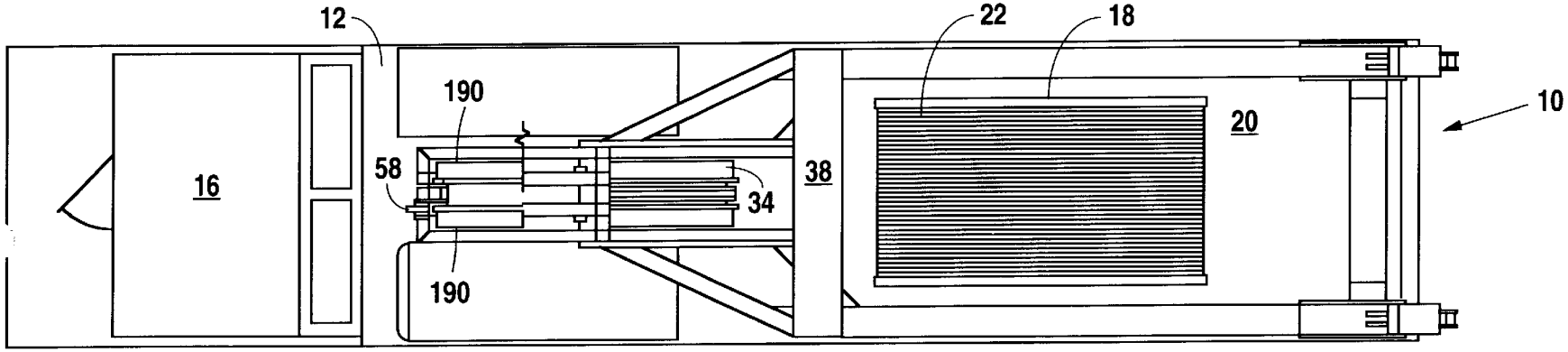
FIG. 2 is a top view of the injector apparatus of FIG. 1.
Figure 3:
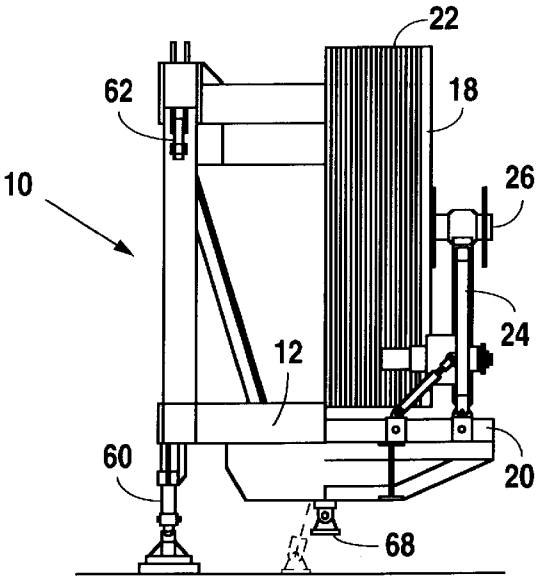
FIG. 3 is a back end view of the apparatus of FIG. 1.

FIG. 2 illustrates a top view of the apparatus 10 with the storage spool 18 and cradle 20 centered on the frame 12 traverse mechanism. The injector reel 34 is in the stored position at the front end of the frame. FIG. 3 is a partial back end view of the apparatus 10 with a bullnose assembly 26 inserted into the storage spool 18. A lateral positioning cylinder 68 is shown attached beneath the frame 12 to provide support and stabilization on uneven terrain.

FIG. 5 shows the mast 38 raised by mast lift cylinder 64 to a tubing injection position generally perpendicular to the frame 12 and at the back end 44 of the frame 12. Swing locks 62 (one on each side of mast 38) have been latched to secure the mast 38 and injector reel 34 in the uplift position. It should be noted that in the injecting position coiled tubing 22 extends from the storage spool 18 up and over the injector reel 34 wrapping the injector reel at an angle or arc greater than 90°.

Hold-down assembly 56 extends around a portion of the circumference of the injector reel more than 90°0 to exert pressure on the coiled tubing as it is injected into the well or returned to the spool. Tubing 22 exits the apparatus 10 generally perpendicularly to the earth's surface as seen in FIG. 5. Angle $A_v$ is generally 90° in when the embodiment of FIG. 5 is in the injecting position. Further, FIG. 5 illustrates that the support frame 24 supporting the bullnose assemblies 26 may be telescopingly vertically raised or lowered to accommodate various storage spool diameters. In FIG. 5 the frame 24 is shown vertically raised to accept a large diameter spool.

The standard spool configuration may be seen in FIG. 4A. The spool diameter is also called the flange height and is designated A. The spool core diameter is shown as B while the spool inside width is designated C and the spool outside width designated D. The present invention 10 will accommodate a spool having a diameter A from 90" to 165" and having spool widths D from 58" to 96".

A telescoping tubing stabilizer 70 has an upper section 71 and a lower section 72 as seen in FIG. 5. The stabilizer 70 extends from the straightener assembly 54 to the B.O.P 74 at the wellhead. The function of the stabilizer 70 is to ensure that the coiled tubing 22 does not bend or excessively flex as it is being injected.

Figure 6:
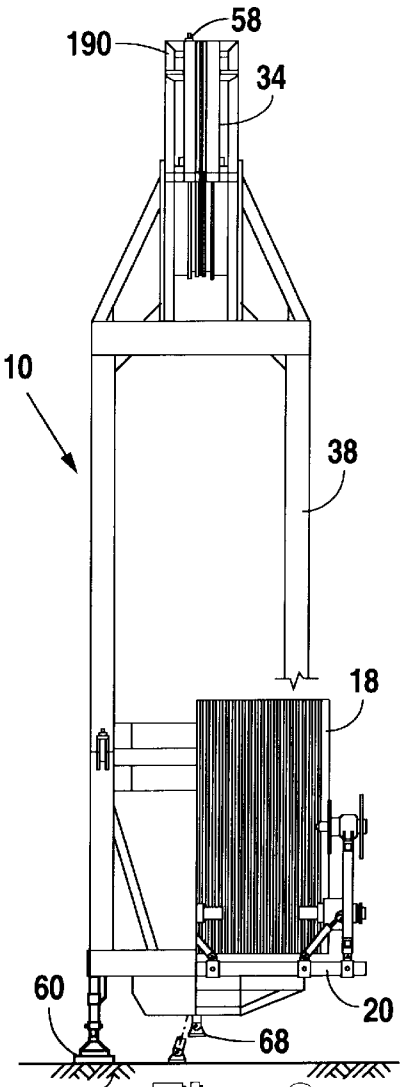
FIG. 6 is a back end view of the apparatus of FIG. 5.

A partial back end view of the injection apparatus 10 is illustrated in FIG. 6. As may be seen the apparatus is in the raised injecting position with the injector reel 34 above the storage spool 18 and frame 12 and generally perpendicular to the earth's surface 80. The storage spool 18 has been traversed to the right on the frame 12 and the cradle 20 extended to support the spool 18. The reel support frame 190 is shown supporting one of the hold-down mechanisms 58.

An alternative embodiment of the present inventive apparatus 11 is shown in FIGS. 7 through 10. In embodiment 11 the frame 12 is mounted on the back of a truck 15. The injector reel is attached to the frame 12 in front of the storage spool 18.

Figure 9:
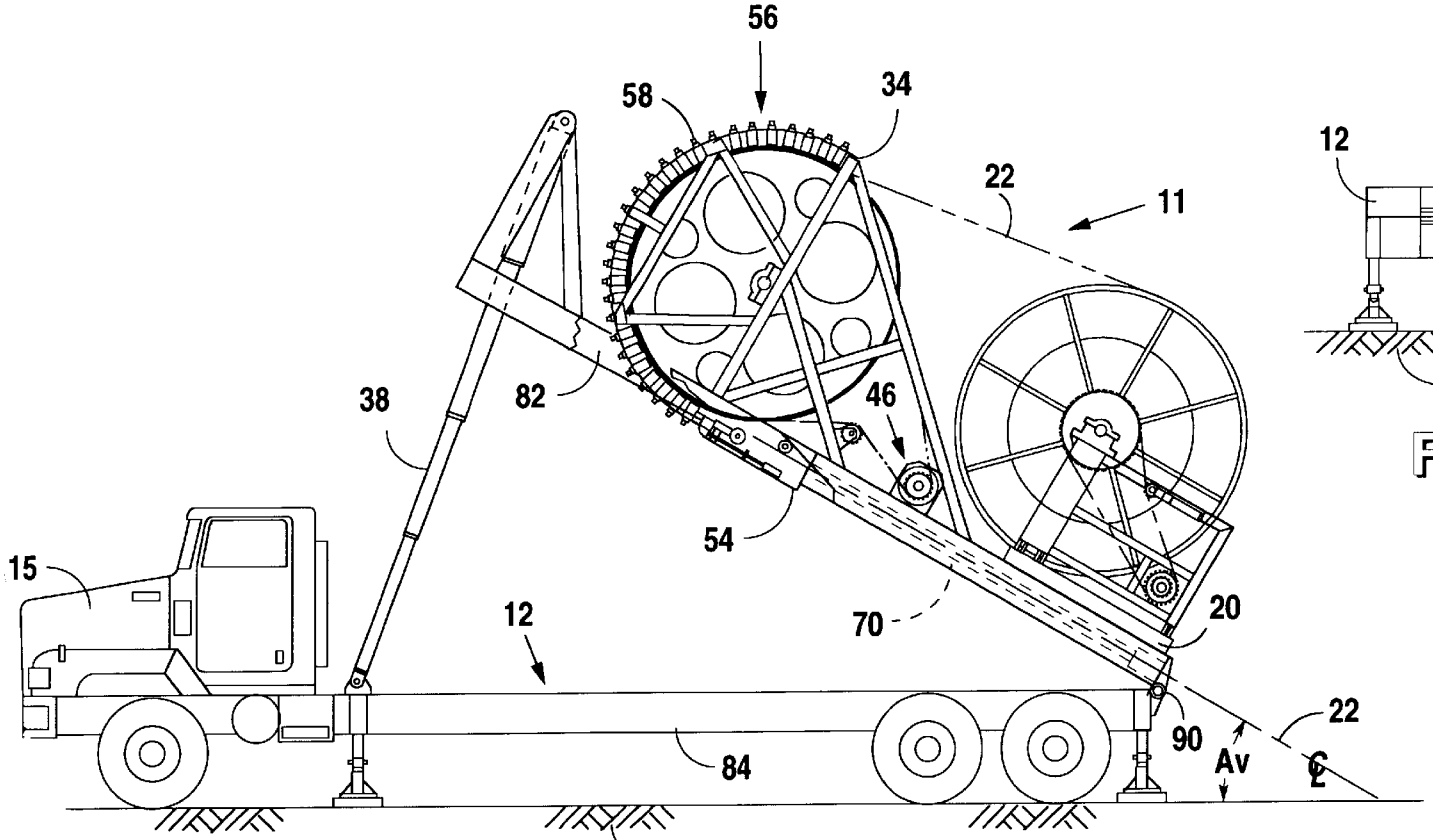
FIG. 9 illustrates a side elevation view of an alternative embodiment of the apparatus of the present invention in the angular injection position.

A pivoting hinge 90 connects an upper frame section 82 to lower frame section 84. A telescoping mast or boom arm 38 is pivotally attached to a front end of the lower frame section 84 and the front end of the upper frame section 82. When the mast is activated the front end of the upper frame section 82 is raised bringing the injector reel 34 above the lower frame section 84 and the storage spool 18 as seen in FIG. 9.

Coiled tubing 22 is directed from the storage spool 18 around the injector reel 34. Both the spool 18 and the reel 34 are provided with drive mechanisms 66 and 46, respectively, to cause each to rotate to push or pull the coiled tubing 22 into or out of the well as desired.

Because of the unique placement and arrangement of the spool 18, the injection reel 34, the mast 38, and the hinge 90, coiled tubing 22 may be angularly injected into a well or hole in the earth's surface 80. FIG. 9 shows the apparatus 11 in the injecting position with the coiled tubing 22 exiting the apparatus 11 at an angle $A_v$ of less than 90° to the earth's surface. An additional feature shown in FIGS. 7 and 9 and provided in embodiment 11 is that the straightener assembly 54 and the stabilizer tube 70 are housed within the upper frame section 82 thereby saving considerable space and assembly time. A second straightener assembly may be attached to the distal end 92 of the stabilizer tube above the well or hole.

Figure 8:
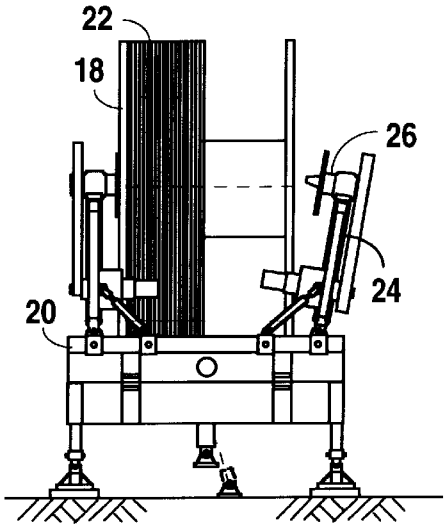
FIG. 8 is a back end view of the apparatus of FIG. 7.
Figure 7:
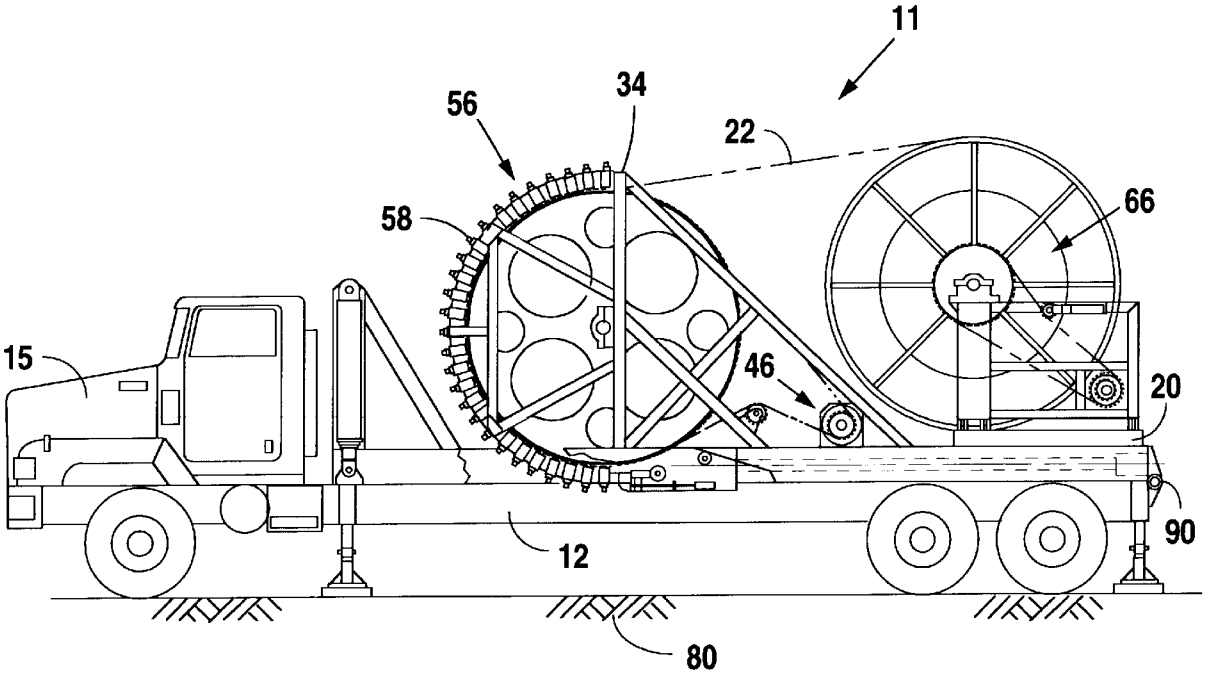
FIG. 7 is a side elevation view of an alternative embodiment of the apparatus of the present invention in the stored position.
Figure 10:
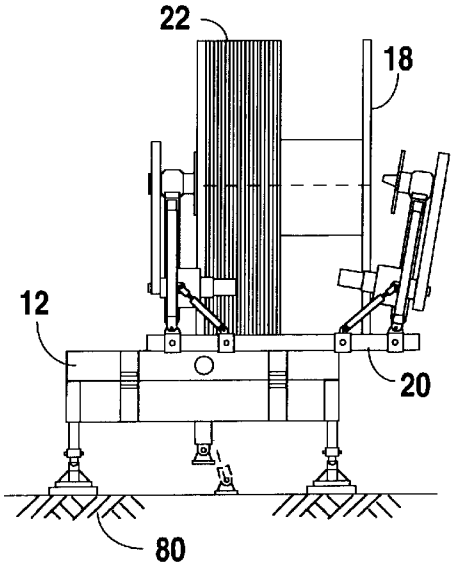
FIG. 10 is a back end view of the apparatus of FIG. 9.

FIGS. 8 and 10 illustrate partial back end views of the alternative embodiment 11. FIG. 8 shows one bullnose assembly 26 retracted and the other inserted. FIG. 10 shows the cradle 20 traversed to the right to its maximum extent.

Figure 11:
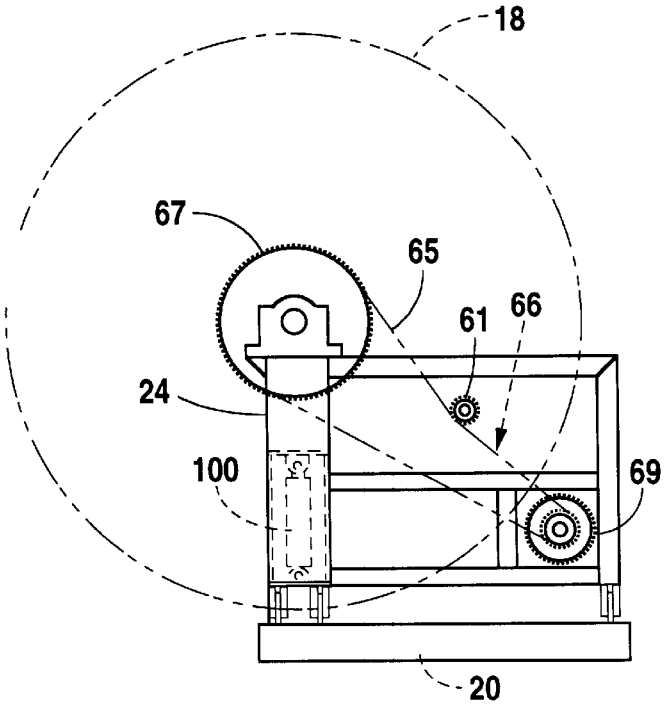
FIG. 11 is an illustration of a side elevation view of the storage spool cradle of the present invention with a small diameter spool shown in broken lines.
Figure 12:
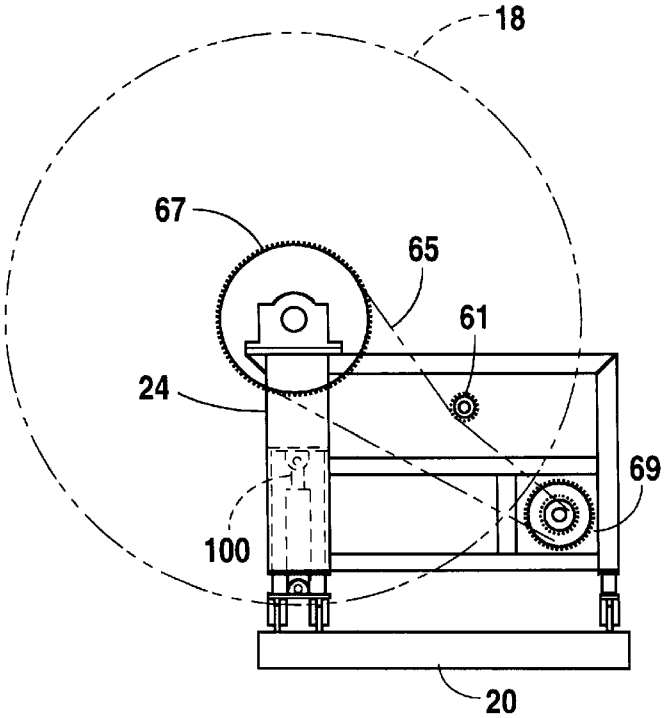
FIG. 12 shows a side elevation view of the storage spool cradle of the present invention with the side frames raised to support a large diameter spool shown in broken lines.
Figure 13:
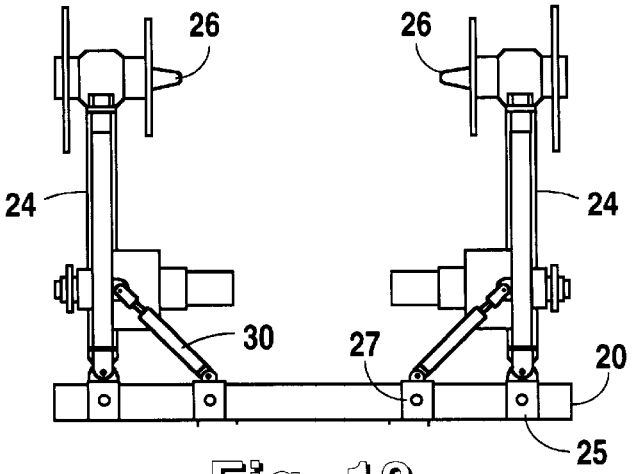
FIG. 13 is an end view of the storage spool cradle with the bullnose arms in the inserted position for a wide spool.

As previously discussed cradle 20 is provided with supports 24 which are adjustable both vertically and horizontally to accommodate various widths and diameters of storage spools. FIGS. 11 and 15 illustrate these features of the present invention. FIG. 11 shows a storage spool 18 slidably attached to cradle 20. Support 24 which supports the bullnose 26 is provided with a hydraulic lifting cylinder 100. FIG. 11 shows cylinder 100 in the retract or lowered position. This position allows the operator to insert and remove a smaller diameter spool. A spool drive mechanism 66 includes a hydraulic motor 69, a drive chain or belt 65 and spool drive sprocket 67. An adjustable idler 61 is provided to enable the operator to vary the length of the drive mechanism to accommodate various diameter spools as may be required. FIG. 12 illustrates the cylinder 100 in the extended or raised position to accommodate a larger diameter spool. The horizontal adjustment of the cradle 20 to accommodate varying spool widths is illustrated in FIGS. 13–15. FIG. 13 shows the supports 24 in the extended or wide position. Sliding connections 25 and 27 allow the supports 24 and bullnose assemblies 26 to be moved apart. FIG. 14 illustrates the supports in the narrow position. Finally, FIG. 15 illustrates the bullnose assemblies 26 in the outwardly pivoted retract position and the supports in the extended position.

Figure 16:
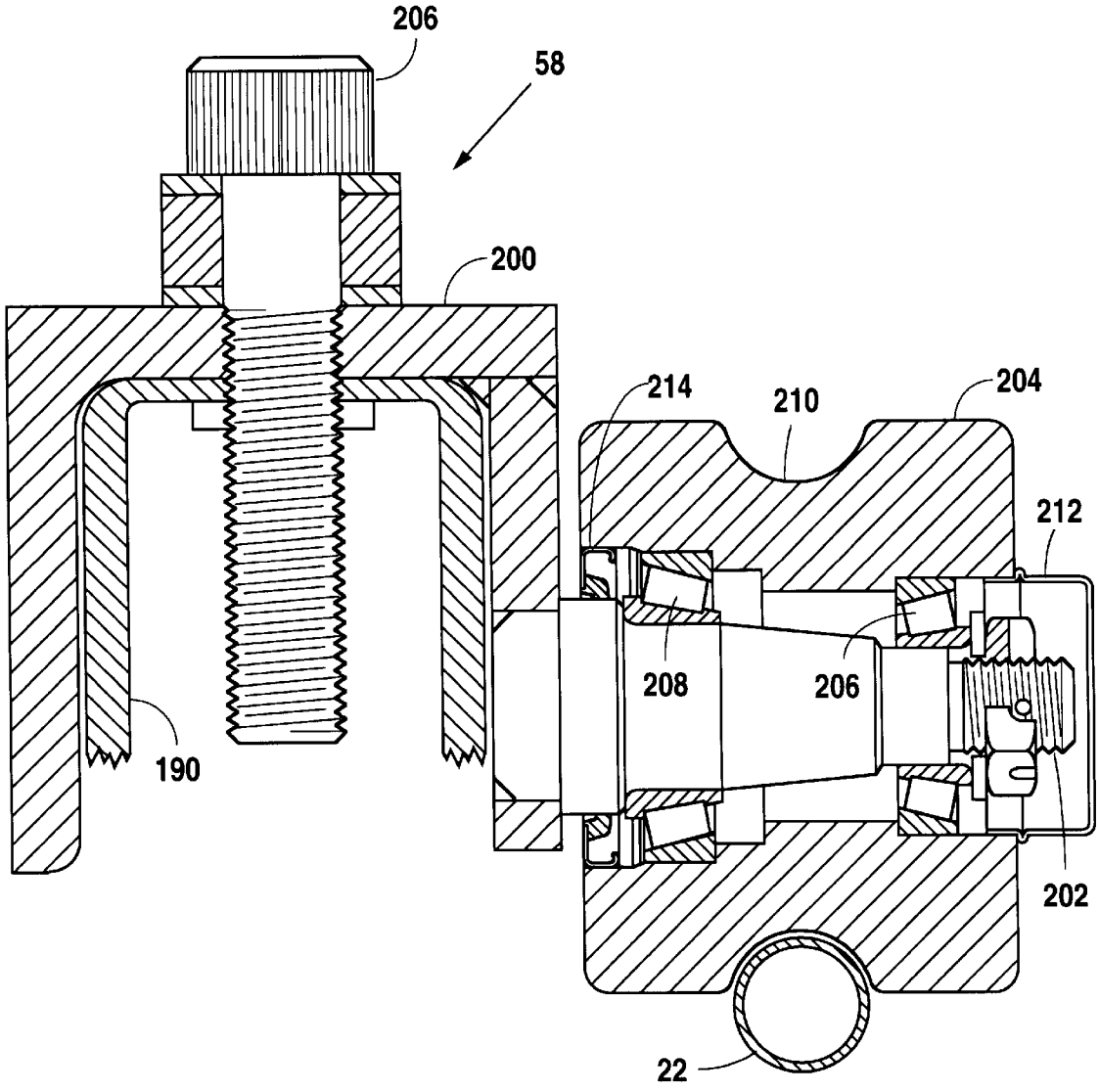
FIG. 16 is a section view of one of the hold down mechanisms constructed according to the teachings of the present invention.

The unique hold-down mechanism 58 of the present invention is shown in FIG. 16. As previously discussed, in the preferred embodiment twenty of the mechanisms 58 are positioned around a portion of the circumference of the injector reel. Each mechanism is provided with a spindle bracket 200, a spindle 202, a roller 204, and a pressure or tension adjustment bolt 206.

The mechanism is attached to the reel frame 190 as shown in FIG. 16. By adjusting bolt 206 the roller 204 may be raised or lowered against the coiled tubing 22 which rides in groove 210 of roller 204. Bearings 208 and 210 are affixed to the spindle 202 to allow the roller 204 to rotate. Dust caps 212 and 214 may be provided to protect and seal the bearings.

By individually adjusting the pressure of the mechanism 58 against the coiled tubing the operator has greater control over the injection and retraction process.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. An apparatus for injecting coiled tubing into a hole in the earth's surface comprising:

a frame having a front end and a back end;

a tubing storage spool removably mounted on said frame at said back end and having said coiled tubing stored thereon;

a mast pivotally mounted on said frame;

an injector reel rotatably mounted on said mast, said injector reel pivotable from a first stored position at said front end to a second tubing injecting position;

a drive mechanism attached to said injector reel to rotate said injector reel; and a hold down assembly mounted around a portion of the circumference of said injector reel for exerting a pressure against said coiled tubing over more than 90° of said injector reel when said injector reel is in said second operative position and said coiled tubing is directed between said hold down assembly and said circumference of said injector reel to provide positive engagement of said tubing by said injector reel when said injector reel is being rotated to pull said tubing off of said tubing storage spool or return said tubing to said tubing storage spool.

2. The apparatus of claim 1 wherein said hold down assembly further comprises a bracket attached to said circumference of said injector reel, said bracket having an adjustment member for varying the pressure of a roller against said coiled tubing.

3. The apparatus of claim 1 wherein said second tubing injecting portion positions said injector reel above said back end of said frame, said mast extending generally perpendicular to said frame, and said coiled tubing exiting said apparatus generally perpendicularly to said surface.

4. The apparatus of claim 1 wherein said second tubing injecting position positions said injector reel above said front end of said frame, and said coiled tubing exits said apparatus at an angle less than 90° to said surface.

5. The apparatus of claim 1 further comprising a first tubing stabilizer assembly mounted within said frame and a second tubing stabilizer mounted above said hole in said surface.

6. The apparatus of claim 1 wherein said tubing storage spool is further removably mounted to an adjustable cradle frame having opposed pivotable bullnose arms.

7. The apparatus of claim 1 wherein said opposed pivotable bullnose arms are horizontally slidably attached to said cradle frame to accept a range of storage spool widths.

8. The apparatus of claim 1 wherein said opposed pivotable bullnose arms are vertically slidably attached to said cradle frame to accept a range of storage spool diameters.

9. The apparatus of claim 1 wherein said drive mechanism is of adjustable length to accommodate a range of storage spool diameters.

10. An apparatus for injecting coiled tubing into the earth's surface comprising:

a frame having a front end and a back end;

a tubing storage reel removably mounted on said frame and having coiled tubing stored thereon;

an injector reel rotatably mounted on said frame;

a mast pivotally mounted on said frame;

a drive mechanism attached to said injector reel to rotate said injector reel;

a multiplicity hold down mechanism mounted around a portion of the circumference of said injector reel for exerting a variable pressure against said coiled tubing when said coiled tubing is directed between said hold down assembly and said circumference of said injector reel to provide positive engagement of said tubing by said injector reel when said injector reel is being rotated to pull said tubing off of said tubing storage reel or return said tubing to said tubing storage reel, each of said hold down assembly further comprising:

a bracket attached to said circumference of said injector reel, said bracket having an adjustment member for varying the pressure of a roller against said coiled tubing; and a tubing straightener mechanism attached to said injector reel.

11. A method of retrieving a length of coiled tubing and storing said tubing on a tubing storage spool comprising:

rotating a reel;

exerting pressure against more than 90° of the circumference of said reel while running said tubing around a portion of said circumference to exert pressure against said tubing to cause positive engagement of said tubing by said reel; and routing said tubing off of said reel onto said tubing storage spool, said tubing storage spool mounted on a cradle vertically and horizontally adjustable to accept varying spool widths and diameters.

* * * * *

US005839514C1

(12) EX PARTE REEXAMINATION CERTIFICATE (6699th)

United States Patent

Gipson

(10) Number: US 5,839,514 C1

(45) Certificate Issued: Mar. 17, 2009

(54) METHOD AND APPARATUS FOR INJECTION OF TUBING INTO WELLS

(75) Inventor: Thomas C. Gipson, Cisco, TX (US)

(73) Assignee: Precision Drilling Corporation, Calgary AB (CA)

Reexamination Request:
No. 90/005,708, Apr. 24, 2000

Reexamination Certificate for:

| | |
|---|---|
| Patent No.: | **5,839,514** |
| Issued: | **Nov. 24, 1998** |
| Appl. No.: | **08/862,745** |
| Filed: | **May 23, 1997** |

(51) Int. Cl.
*E21B 19/22* (2006.01)
*E21B 19/00* (2006.01)

(52) U.S. Cl. ..... 166/384; 166/77.2; 166/85.5; 242/399.1; 242/596.3; 254/268; 254/332; 254/333

(58) Field of Classification Search ..... 166/77.1, 166/77.2, 85.5, 384, 385; 242/399, 399.1, 242/399.2, 592, 596.3, 596.8; 254/281, 288, 254/326, 332, 333
See application file for complete search history.

(56) References Cited

U.S. PATENT DOCUMENTS

| | | | | | |
|---|---|---|---|---|---|
| 2,345,816 | A | | 4/1944 | Hays | 175/82 |
| 3,116,781 | A | | 1/1964 | Rugeley et al. | 166/77.2 |
| 3,116,793 | A | | 1/1964 | McStravick | 166/77.2 X |
| 3,291,256 | A | | 12/1966 | Eitel | 182/129 |
| 3,559,905 | A | | 2/1971 | Palynchuk et al. | 166/77.3 |
| 3,690,136 | A | | 9/1972 | Slator et al. | 166/77.2 |
| 3,722,775 | A | | 3/1973 | Sarracino et al. | 226/100 |
| 3,762,725 | A | | 10/1973 | Taylor | 166/84.4 |
| 3,777,964 | A | | 12/1973 | Kruner et al. | 226/183 |
| 3,794,233 | A | | 2/1974 | Dykmans | 226/183 |
| 3,841,407 | A | * | 10/1974 | Bozeman | 166/384 |
| 3,872,680 | A | | 3/1975 | Nicholson et al. | 405/168.3 |
| 3,902,612 | A | | 9/1975 | Hall | 414/486 |
| 4,003,435 | A | | 1/1977 | Cullen et al. | 166/385 |
| 4,009,754 | A | | 3/1977 | Cullen et al. | 166/77.1 |
| 4,066,093 | A | | 1/1978 | Egerstrom | 137/355.2 |
| 4,103,841 | A | | 8/1978 | Flynn et al. | 242/390.3 |
| 4,145,014 | A | | 3/1979 | Chatard et al. | 242/390.9 |
| 4,249,600 | A | * | 2/1981 | Bailey | 166/77.2 |
| 4,553,590 | A | | 11/1985 | Phillips | 166/53 |
| 4,673,035 | A | * | 6/1987 | Gipson | 166/77.1 |
| 5,439,066 | A | * | 8/1995 | Gipson | 166/117.6 |
| 5,660,235 | A | * | 8/1997 | Sola | 166/384 |
| 5,765,643 | A | * | 6/1998 | Shaaban et al. | 166/384 |

FOREIGN PATENT DOCUMENTS

| | | |
|---|---|---|
| CA | 953272 | 8/1974 |

OTHER PUBLICATIONS

Advertisement: Fleet Coiled Tubing Unit, Vita International, Inc., 42 (1996–97) Composite Catalog, May 7, 1996.*
Otis Engineering Corp., advertisement, 46 Drilling: The Wellsite Publication 2–3 (Feb. 1985).
Brochure: Product Data: Fleet Coiled Tubing Unit, Vita International, Inc., May 7, 1996.

* cited by examiner

*Primary Examiner*—George Suchfield

(57) ABSTRACT

An improved apparatus and method for injecting and retrieving a length of coiled tubing and storing the tubing on a storage spool. An injector reel is pivotally mounted on a frame such that coiled tubing may be angularly injected to shallow, horizontal wells. A hold-down assembly is provided to individually adjust the pressure applied to the coiled tubing as it is injected into or retrieved from a well. The positioning of the injector reel and the storage spool in the injecting mode ensures a greater degree of wrapping of the coiled tubing around the injector reel to improve the control of the injection and retraction of the tubing. A vertically and horizontally adjustable storage spool cradle enables the operator to vary the width and diameter of the storage spools used in the apparatus.

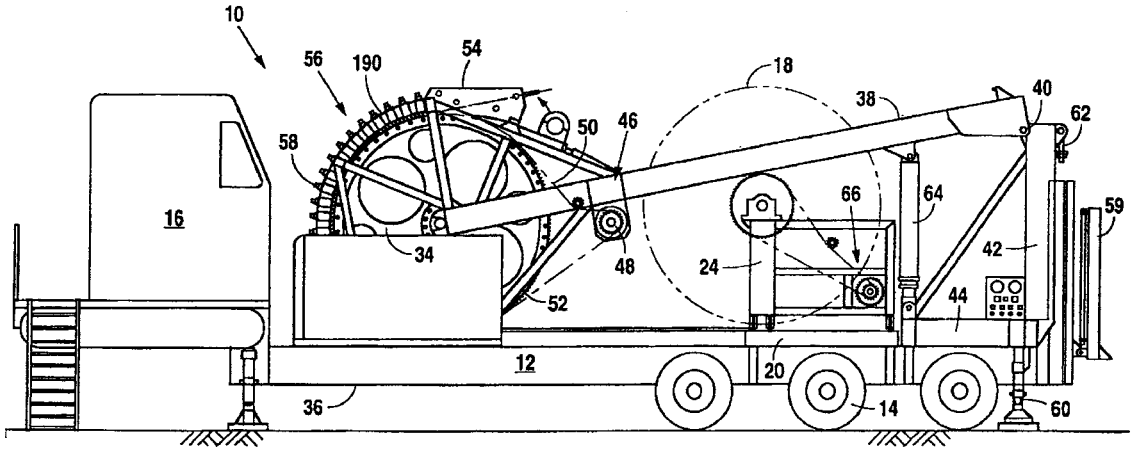

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–11 are cancelled.

* * * * *